US005868191A

United States Patent [19]

Blackmon, Jr.

[11] Patent Number: 5,868,191

[45] Date of Patent: Feb. 9, 1999

[54] ADJUSTABLE WINDOW TREATMENT SYSTEM

[76] Inventor: Herbert Blackmon, Jr., 1645 E. 50th St., Chicago, Ill. 60615

[21] Appl. No.: 827,891

[22] Filed: Apr. 7, 1997

[51] Int. Cl.[6] ..... A47H 1/00

[52] U.S. Cl. ..... 160/31; 160/24; 160/39; 160/240; 160/263; 160/237

[58] Field of Search ..... 160/23.1, 24, 31, 160/240, 263, 237, 26, 273.1, 39

[56] References Cited

U.S. PATENT DOCUMENTS

| | | | |
|---|---|---|---|
| 1,130,565 | 3/1915 | Bishop | 160/240 X |
| 1,146,818 | 7/1915 | Rodecker | 160/263 X |
| 1,216,794 | 2/1917 | Garman | 160/240 X |
| 1,221,564 | 3/1917 | Mills | 160/240 |
| 1,238,642 | 8/1917 | Crump | 160/263 |
| 1,363,746 | 12/1920 | Nossek | 160/263 |
| 1,608,667 | 11/1926 | Poetsch | 160/23.1 |
| 1,736,527 | 11/1929 | Garcia | 160/263 X |
| 1,782,977 | 11/1930 | Soderqvist | 160/263 X |
| 1,815,551 | 7/1931 | Dunn | 160/273.1 X |
| 1,867,391 | 7/1932 | Traut | 160/31 X |
| 1,898,686 | 2/1933 | Rice | 160/263 |
| 2,041,105 | 5/1936 | Barnhart | 160/31 |

*Primary Examiner*—Blair M. Johnson
*Attorney, Agent, or Firm*— Lee,Mann,Smith,McWilliams, Sweeney, and Ohlson Firm

[57] ABSTRACT

A device for the treatment of a window or opening that is interchangeable with a variety of rolled sheet materials and serving the purpose of a bug screen, shade screen for sunlight, or an insulating barrier for thermal protection. The device housing, roller tube, and rolled sheet materials are adjustable as to accommodate openings of different widths and heights. The device comprises an adjustable housing which contains an adjustable roller tube upon which the window treatment material is rolled. The adjustable tube has catches at its ends which engage slots near the edges of the treatment material thereby keeping the material at the same width as the adjustable tube when the material is rolled upon the tube. Extending perpendicularly outward from the ends of the housing are adjustable slotted tracks whose slots engage hooks on the sides of the treatment material thereby holding the material in the opening.

19 Claims, 6 Drawing Sheets

ADJUSTABLE WINDOW TREATMENT SYSTEM

BACKGROUND

1. Field of Invention

The present Shade Insulator Screen System (SISS) relates primarily to windows but not limited thereto due to its versatility. Therefore consideration of this device in other related apertures or openings will apply as well.

2. Description of Prior Art

There are many types of shades, screens, and blind systems on the market today. Many of these systems are limited in versatility.

Usually many window systems come in one color, pattern, style or type and in a standard dimension. Most often these systems will have to be custom-made to fit the window or opening as needed. This means that more precise measurements will need to be taken.

In many related patents, the focus has been on creating a device with telescoping end(s) that would be able to fit a range of window widths.

In U.S. Pat. No. 4,619,305 to Comeau (1986) a semi-adjustable shade and roller combination in which the shade material is non-stretchable and mounted on a telescoping roller comprising of an outer and inner roller and having a split plastic sleeve over the inner telescoping roller. The patent states, "Therefore it is expected that accurate width trimming to any desired size will be required." This means the material could not be cut too short, if it is, the consumer must attain another sheet. Therefore, in trying to cut material to an accurate width dimension can be costly, time consuming, and difficult to manage, whether it is rolled out flat or rolled on a roller.

The Comeau patent also states regarding the split sleeve that it is, "stiff but resilient." That means that the split sleeve must also be cut so that it can match the length dimension with the telescoping inner roller if the shade material is to be wound correct and even as stated. Therefore, cutting this material can be difficult.

A common problem that many older windows in building structures have, is with thermal conductivity due to old design standards, moreover, air seepage around them. In most situations this is dealt with by caulking around windows or replacing older windows with new windows. For example, storm windows, which can be costly for home owners and apartment complexes, or it may be dealt with by adding curtains or in some cases a sheet of plastic. The latter is certainly not the most appealing or desired.

In U.S. Pat. No. 4,458,739 to Murry and Wagner (1994) a insulative roll-up shade system is presented. Regarding the flexible sheet, the header or casing and the side guides or channels, all will have to be custom-made to fit a particular window structure or opening to meet the demand of various sizes. Having to meet this demand can influence the cost of production in time and money.

The system referred to in the above patent is very rigid in its construction in that none of the components of the system can adjust. This is important because it means that for the system to function in the capacity that it is intended for, that not only will dimensions have to be taken, but accurate dimensions. For example, what if the system is pre-built in a factory with dimensions for a specific window size in mind, and the consumer receives the system and it is not to the specified dimensions? Or, what if the system is packaged in a way to be sold retail and the consumer has to worry about the cutting and the putting together of the parts and the parts are cut too short?

One common problem that many of the aforementioned and related devices have, including U.S. Pat. No. 4,102,385 to Gerald W. Miller, is the difference in the diameter of the main tube or roller and the telescoping portion. In the patent to Miller, it states how this issue is handled between the first and second roller sections. It is dealt with by wrapping the shade material around the projecting portion of the second roller section a number of times sufficient to a diameter approximately equal to the diameter of the first roller. So the shade material plays an important part in this system and is a "special shade material" that could not be interchanged perhaps with a sheet that did not have end portions that made up the difference in the two roller diameters. Also once the perforated portions are torn there is no recourse.

There have been ways that these and other issues have been dealt with in subsequent patent applications. It will become apparent from the drawings and specifications, how some of these issues have been addressed in a way to develop a unique device for an adjustable window treatment system.

OBJECTS AND ADVANTAGES

It is an object to invent a device for the treatment of a window or opening that can be interchanged with a variety of rolled sheet materials to be used as, a bug screen, a shade, or thermal barrier.

It is an object to provide versatility by means of the rolled sheet material in: color, fabric, style and design.

It is an object to provide a device that can be placed vertical or horizontal in a window or opening or on the outside face or interior face of a window structure or opening.

It is an object to provide a device that can be used with or without a track system It is an object to provide a device that adjusts to fit a range of window sizes or openings without having to be pre-built to a specific dimension.

It is an object to provide a device that can be easily installed.

Some of the advantages of the adjustable window treatment are:

The diameter of the main portion of the tube is approximately equal to the diameter of the adjusting portion of the tube.

There would be no need to cut the special rolled-sheet material

No precise measurements will need to be taken.

The entire device will be adjustable to fit a range of sizes.

The device is assembled in such a way as not to be tedious for operational use.

The ability to use the device in another location for use at another window unit or opening without having to make major modifications to the device.

There will be other object and advantages that will become apparent from the drawings and specifications.

Figure 1:
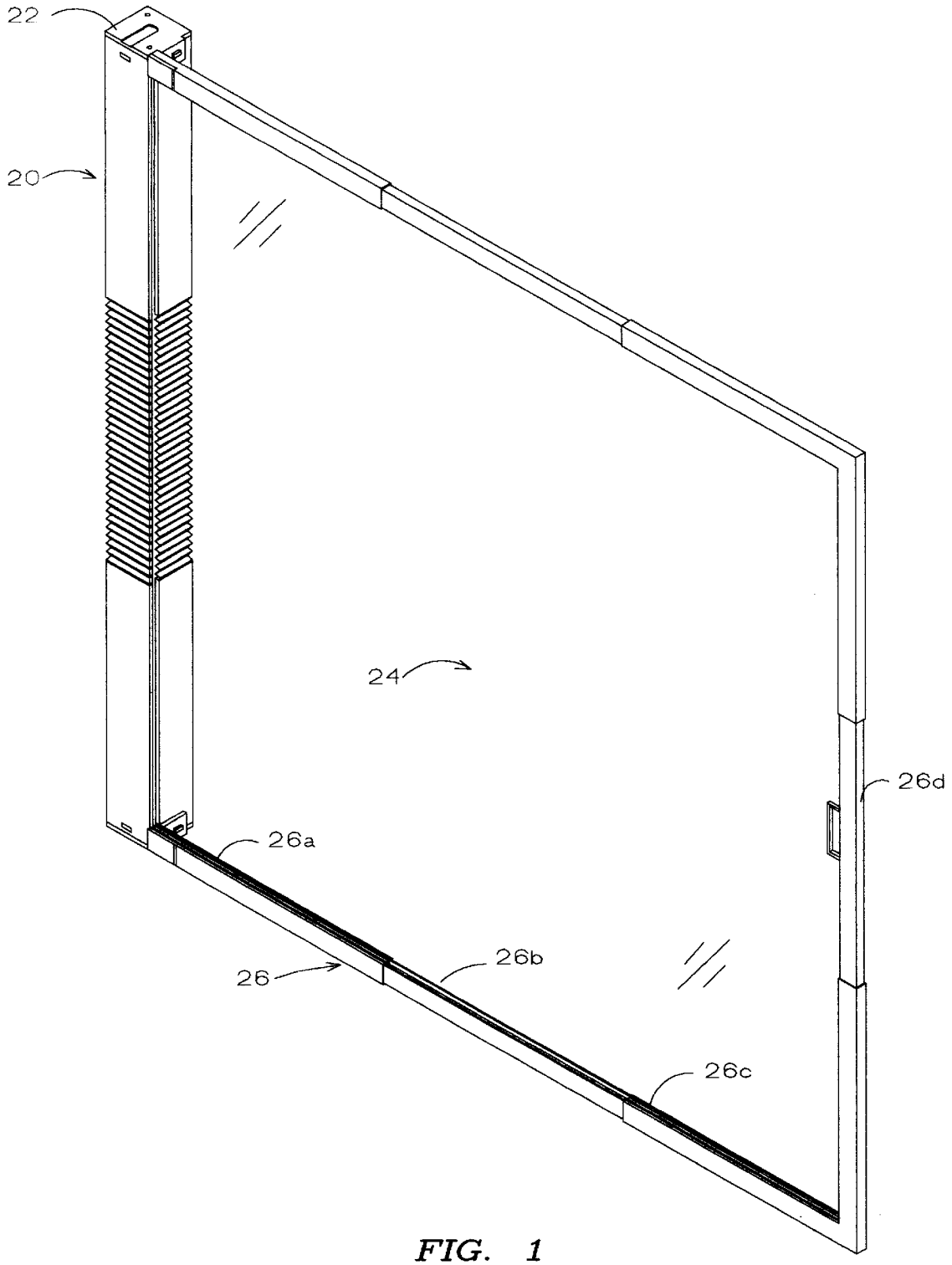
FIG. 1—an isometric view of the device showing the main exterior features.

| Reference Numerals In Drawing |
|---|
| 20- Housing |
| 20a- housing end |
| 22- Outer cap |
| 22a- Slot |
| 22b- Brace |
| 24- Special-rolled-sheet-material |
| 26- Track assembly |
| 26a- Straight track |
| 26b- Linking track |
| 26c- Angled track |
| 26d- Linking track |
| 26e- Orifice |
| 30- Inner cap |
| 32- locking mechanism |
| 32a- Orifice |
| 34- Guide |
| 36- Socket |
| 40- Slit |
| 40a- Slit |
| 42- Flexible cover |
| 44- Keyway |
| 48- locking mechanism |
| 48a- Orifice |
| 54- Key |
| 58- Bar |
| 62- Tube assembly |
| 63- Main tube |
| 63a- Finger |
| 64- Channel |
| 65- Catch |
| 66- Adjusting end |
| 66a- Finger |
| 73- Head |
| 74- Attachment hole |
| 76- Inner rod |
| 77- Key |
| 78- Main rod |
| 79- Keyway |
| 80- Slot |
| 81- Flange holder |
| 82- Flange |
| 82b- Flange |
| 83- Flange holder |
| 89- Stretchable ends |
| 90- Seams |
| 92- Fastener |
| 94- Bar |
| 95- Hooks |
| 95a- Slots |
| 96- Bar |
| 97- Expander |

SPECIFICATION

An adjustable Window Treatment System. A device made in several standard widths. For example, a 2 ft unit would be able fit a range of sizes between 2 ft and 3 ft and a 3 ft unit would be able to adjust to fit a range of sizes between 3 ft and 4 ft, etc.

The device can be positioned horizontal or vertical and placed on the face or the interior of a window structure or opening. It also can be used with or without a track system, depending on the intended use or position of the device.

For example, if the device was used as a bug screen, insulating barrier, or positioned vertically, then a special-rolled-sheet material (rolled material presented in this application) would need to be used to support the sheet as it extends from within the housing along the track. The track system would also be adjustable horizontal and vertical. In addition, the track serves the purpose to aid in insulating the perimeter of a window or opening. If the device is used for a shade or similar use, any common rolled sheet material (any material that is used in related devices) can be used, as long as its width dimension is approximately equal to the adjustable tube in either its original position or extended position.

An elongated housing that has independent housing end that are similar, is made to adjust along an elongated bar that is positioned between each housing end. A tube assembly is also located within the housing that is shielded by a flexible cover located between the housing ends.

A slit that runs through each housing end and the flexible cover allows for the special material or the common material to exit the housing.

In addition, an orifice for securing an inner cap is located at the end of each housing end. The outer cap is designed to be positioned on the interior or the face of a window structure or opening. When positioned on the face of the window structure or opening, the cap can be used with an optional brace that fits in the outer cap that has a slot in it to receive the brace.

The inner cap fits in the interior of the housing at the end of the housing end where there is an orifice that is in the shaft that allows the locking mechanism on the inner cap to be secured. Also on the surface of the inner cap is a guide that is used for the "special material" to hold and keep the material in tension as it extends from within the housing along the track. This guide helps to ensure proper tracking for the "special material." A geometrically shaped socket is also located in the inner cap and is used to secure the end of the tube assembly.

The tube assembly consists of an elongated main tube that has a channel that runs the approximate length of the main tube that is used for securing either the common material or the special material.

At each end of the main tube are finger-like ends that mate with the adjusting ends that are also finger-like. These finger-like formations between the two parts, interlock with one another. This allows the adjusting ends to move laterally along the axis of the tube assembly while still being joined with the main tube. Thus when the main tube rotates, the adjusting ends will rotate as well.

On the interior of the main tube is a main rod that runs the approximate length of the main tube. The main tube and main rod are joined approximately at mid-span by a flange holder that is located on the interior of the main tube and a flange that is located on the main rod. This joining prevents the main tube and the main rod from separating from each other and prevents any axial movement between the two parts along the tube's axis. This allows the main tube to rotate about the axis of the tube assembly and still remain joined to the main rod.

Also included in the main rod, is a keyway that is the approximate length of the key on the inner rod. The key and the keyway are mating parts. The mating between the two parts allows the inner rod that operates within the main rod to adjust along the axis but prevents the main rod and the inner rod from having any rotation independent of one another.

Located at the end of the inner rod, is a flange that operates within the flange holder of the adjusting end. This joins the inner rod to the adjusting end and still allows the adjusting end to rotate about the tube's axis while also being able to adjust along the axis simultaneously with the inner rod. Also adjacent to the flange of the inner rod is a geometrical shaped head that is integral with the rod. This head on the inner rod fits into the geometrically shaped socket that is located on the inner cap.

In summation, the main tube and the adjusting ends rotate about the tube's axis and the main rod and the inner rod does not rotate. The adjusting ends and the inner rod are simultaneously adjustable in axial movement along the tube's axis.

Furthermore the main rod is joined to the inner rod that will be secured to the inner cap that will not be able to rotate once the inner cap is secured in the housing. So the main rod and inner rod will serve as a support for a retractable mechanism that will be able to wound the rolled material back within the housing.

Concerning the "special material" that will be used with the device, it should be noted that the device can be used as any other roll-up type shade system or related device. In other words the system does not have to incorporate the "special material" to be operational for common use, that is, any use other than serving as an insulative barrier, or being arranged in a way as to need additional support, or the necessity to adjust the device at will.

The "special material," would consist of a material that is flexible but non-stretchable and has a width approximately matching the width of the main tube. Also adjacent to the non-stretchable material are stretchable-ends that stretch to meet the adjusting ends of the tube assembly when they are in an extended position.

The non-stretchable material can be a meshed screen made of wire or plastic for use as a bug screen, a tinted plastic or fabric material that could be used as a shade. The idea is to have a device that can be interchanged with a variety of rolled material for different purposes. Therefore, the non-stretchable material should not be limited thereto any specific material type, or pattern.

The stretchable ends are made from a polyurethane that is stretchable. One such film, Dureflex™, manufactured by Deerfield Urethane in South Deerfield Mass. This material is opaque and stretchable. Although this film is identified herein, there are many other films, fabric or other materials that are of a stretchable nature that potentially could be used for this purpose. These may have a greater elongation capability, for example Spandex™.

Also the stretchable ends are a composite of several portions of polyurethane. Each having a width of approximately ¼ in. that are heat sealed or chemically sealed at the joints, the length of the sheet.

Adjacent to the stretchable-ends are a plurality of slots at consistent intervals the length of the non-stretchable sheet that coincide with several catches that are located at the end of the adjusting ends of the tube assembly. The catch keeps the stretchable-ends in tension as the "special material" is wound and unwound.

Adjacent to the slots are hooks that are used to keep the adjusting ends placed properly. As the "special materials" is unwound from the tube assembly, it enters a guide that is located on the inner cap and from there will enter the track. The hooks are equally spaced per revolution about the tube in such a way, that for every revolution that a set of hooks makes, the next generation moves just beyond the width of the previous generation of hooks so as not to interfere with the last generation of hooks. This will allow the hooks to have a width that is greater than the thickness of the stretchable ends so that when the material is rolled on the tube, the thickness of the hooks will not cause a variation in height in the material as it wraps around the tube.

About FIG. 1, the main features of the device, a housing 20, a tube assembly 62 (not shown), a special-rolled- sheet-material 24, an outer cap 22 and an inner cap 30 (not shown). Continuing on, a track system 26 that is adjustable vertically and horizontally. The track system 26 comprises of, a straight track 26*a* that is attached to the housing 20. The straight track 26*a* in continuation is joined to a linking track 26*b* that is adjustable within an angled track 26*c*. The other side of the track system 26 is a mirrored image of the previously mentioned set of tracks and is joined by another linking track 26*d*. The track system is secured to the housing in anyway commonly known in the art.

Figure 2:
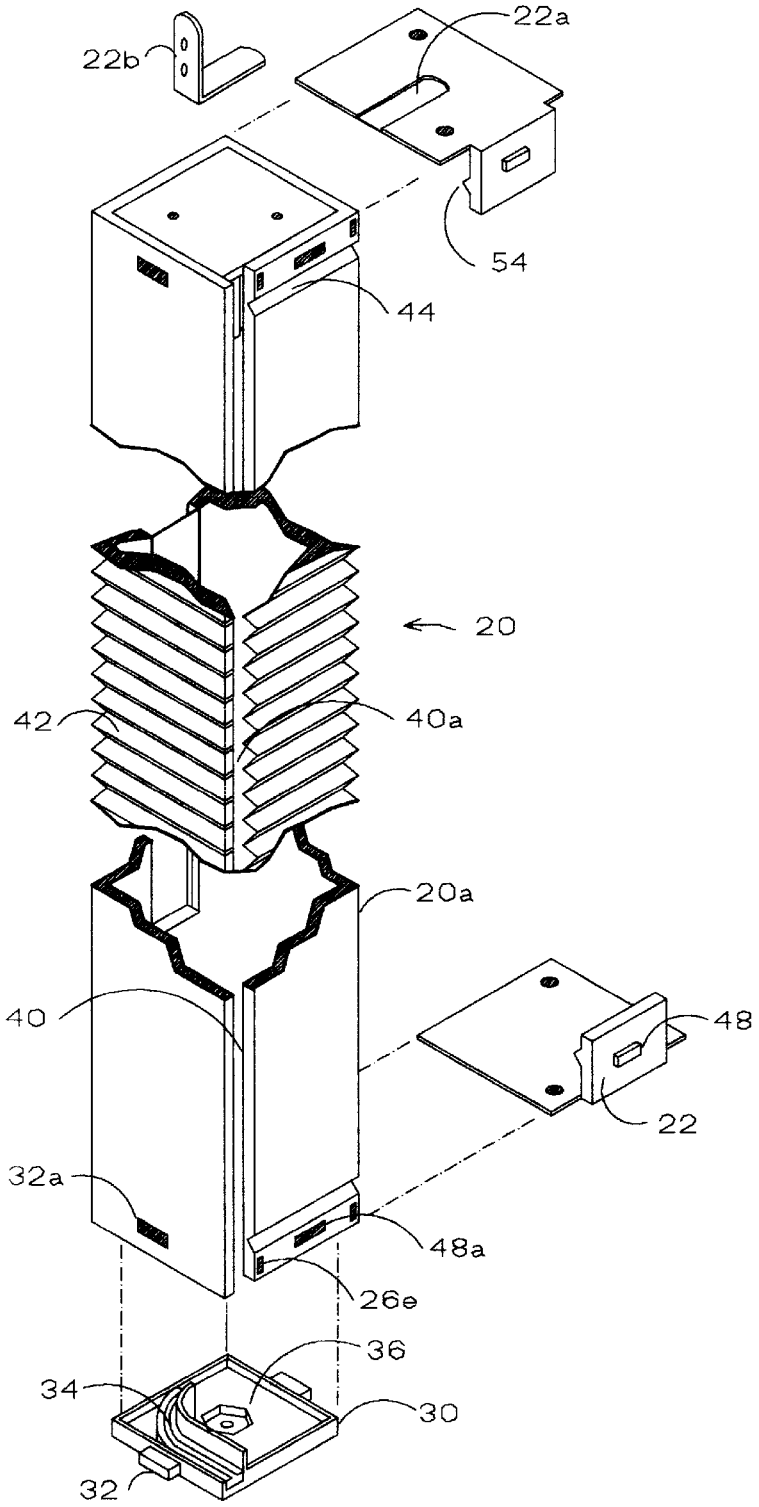
FIG. 2—an enlarged view showing in more detail features of the housing 20.

About FIG. 2, the housing 20 has independent housing ends 20*a* that each have a continuous slit 40 that runs through each housing end. Located at one end of the housing end 20*a* is an orifice 32*a* for securing the inner cap 30. There is also a locking mechanism 48 at the end of the housing similar to locking mechanism 32 on cap 30 that engages orifice 48*a* in the outer cap 22. The locking mechanism 48 may be any of the type known in the art that will adjust in such a way to allow the housing 20 to slide into position along the key 54 and be held in place by the cap 22.

Each housing end 20*a* is joined by an elongated bar 58 (shown in FIG. 3) in which the housing end 20*a* are adjustable along the bar 58.

A flexible cover 42 that is located between each housing end 20*a*, adjust with the movement of the housing ends 20*a* as they move back and forth along the bar 58.

At the end of each housing end 20*a* a keyway 44 allows the housing end 20*a* to slide within the outer cap 22 that has a key 54 located on the interior of the cap. On the surface of the cap 22 a slot 22*a* used to affix a brace 22*b* (optional) to the face of a structure, if the need arises.

The inner cap 30 has on the top surface a guide 34 that serves to keep the special material 24 in place as it is extended from within the housing 20 along the track 26.

Also located on the surface of the cap 30 is a socket 36 that has a geometric shape that allows the head 73 that is connected to the inner rod 76 of the tube assembly 62 (shown in FIGS. 4,5) to correspond to the geometric shape of the socket 36.

Figure 3:
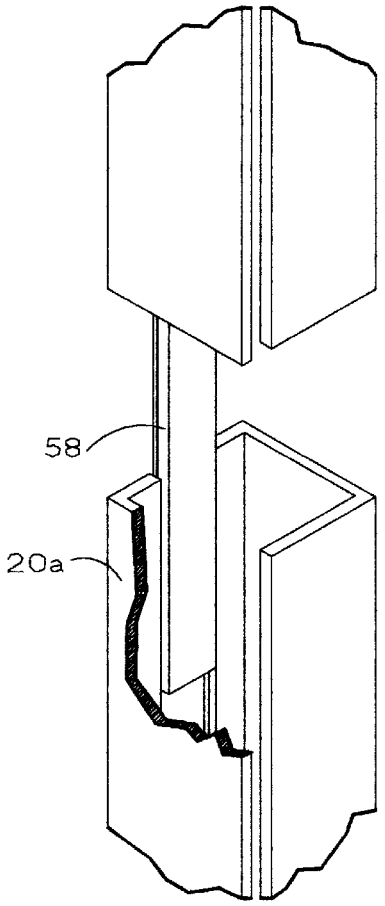
FIG. 3—a partial view showing the bar 58 that operates between the independent housing end.

In reference FIG. 3, the independent housing ends 20*a* are joined by the bar 58.

Figure 4:
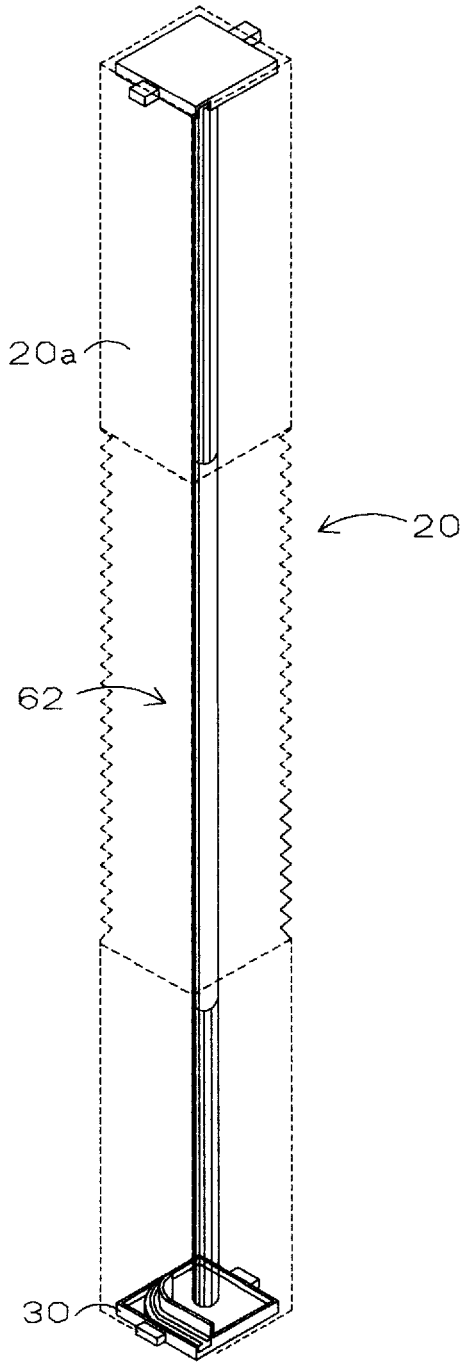
FIG. 4—an isometric view showing the tube assembly 62 in the interior of the housing.

About FIG. 4, the tube assembly 62 is located on the interior of the housing 20. The tube assembly 62 adjusts simultaneously with the movement of the housing ends 20*a* and is shown attached to the inner cap 30. Also the tube 62 along with the inner caps 30 can be removed at convenience from the housing 20 to change the sheet material.

Figure 5:
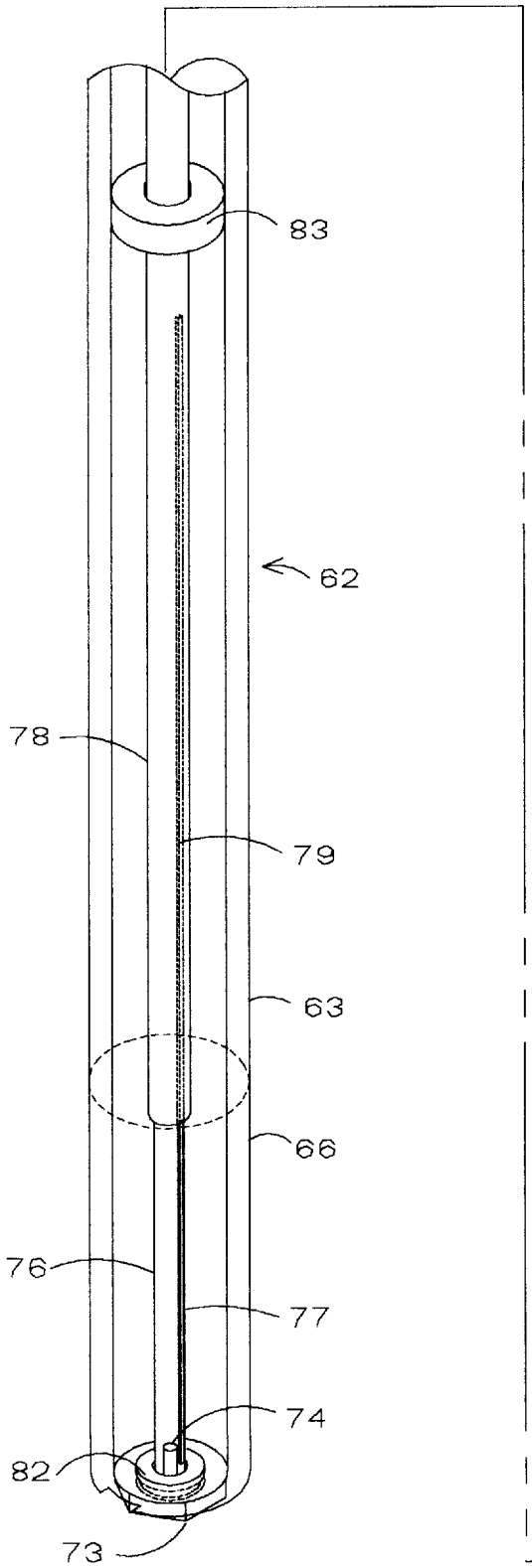
FIG. 5—a view of half of the tube assembly 62 showing the interior features therein.

About FIG. 5, on the interior of the tube assembly 62 the main rod 78 has an outside diameter less than the diameter of the main tube 63 and has a distance approximate to the length of the main tube 63.

The main rod 78 has a keyway 79 in it that mates with the key 77 that runs along the inner rod 76. This arrangement allows the rod 76 to adjust along the tube's axis and prevents the rod 76 and the rod 78 from rotating independent of one another.

The inner rod 76 that has a length approximate to the length of the adjusting end 66, has at the end of it, a geometrically shaped head 73 that fits into the socket 36 on the inner cap 30 and is mechanically fastened at 74.

Once the tube assembly 62 is secured to the end cap 30 at the head 73 that is connected to the inner rod 76, this will prevent rotation of the rod 76 and the rod 78 while allowing the main tube 63 and the adjusting tube 66 to rotate about the tube's axis.

Figure 6:
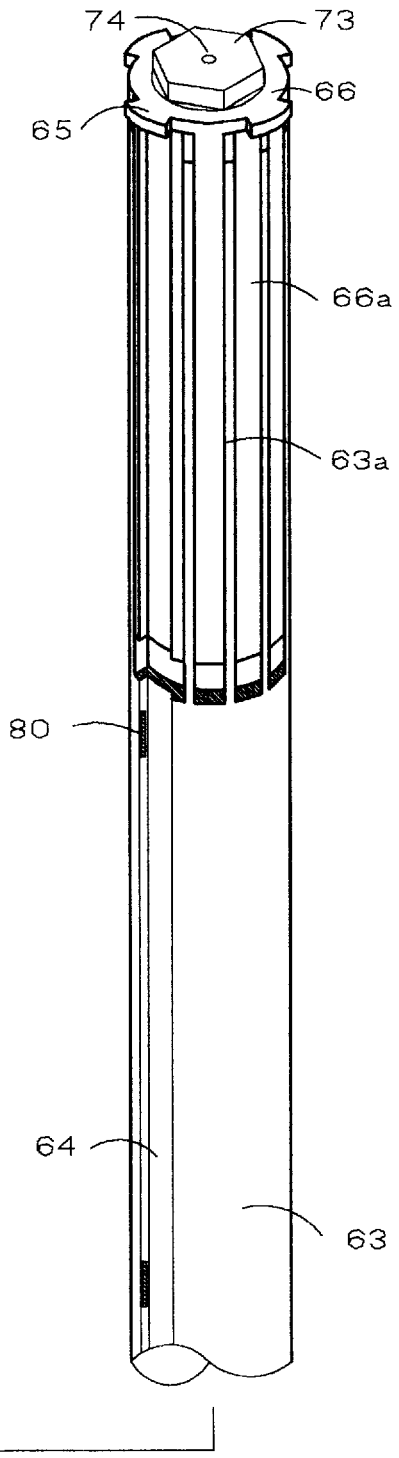
FIG. 6—a view of the second half of the tube assembly 62 showing the exterior features thereof.

About FIG. 6, the main tube 63 has fingers 63*a* at each end of the main tube 63. A channel 64 runs the approximate length of the tube 63 and is used to place the bar 96 (FIG. 10) that is attached to the rolled sheet material 24. The bar 96 is then secured at the attachment slots 80 on the tube 63.

The adjusting end 66 also has fingers 66*a* that interacts with the fingers 63*a* on the main tube 63. The adjusting end 66 is able to adjust along the fingers of the main tube 63.

The length of the adjusting end 66 is approximately one half of the length of the main tube 63 and has a diameter approximately equal to the diameter of the main tube 63.

Figure 7:
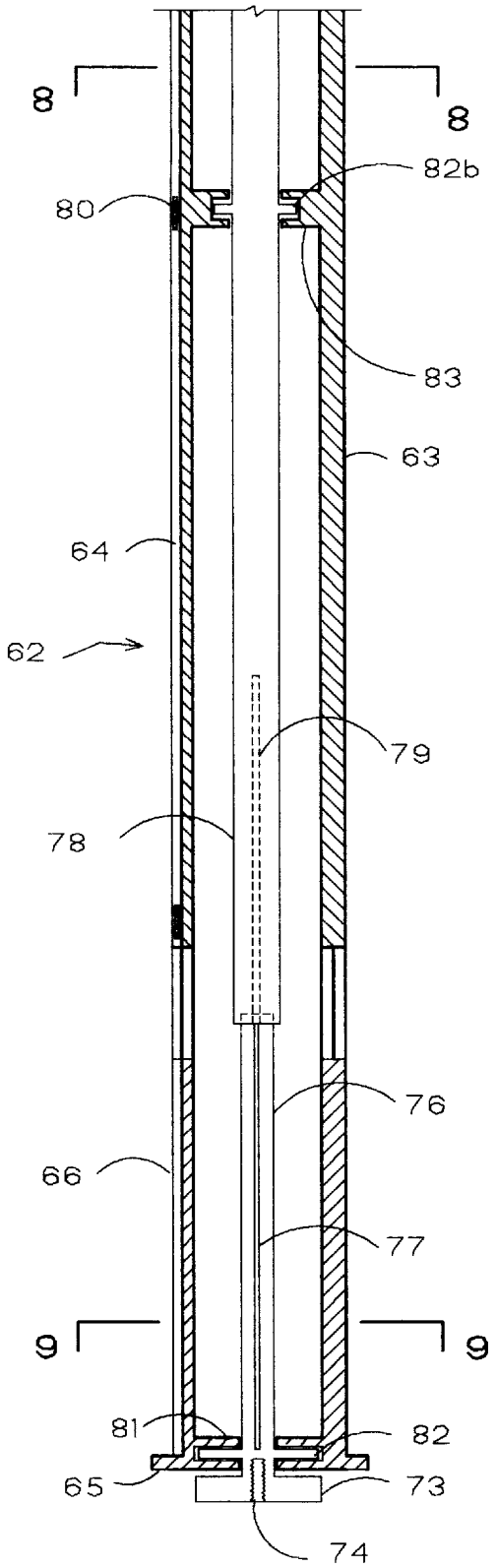
FIG. 7—section through the tube assembly 62.
Figure 8:
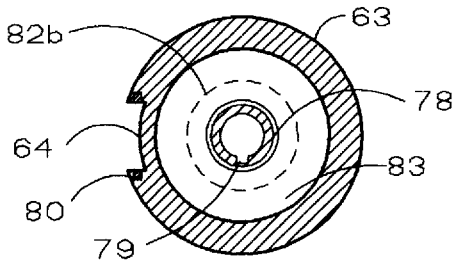
FIG. 8—cross sectional view on line 8—8, FIG. 7 through the main tube 63 and main rod.
Figure 9:
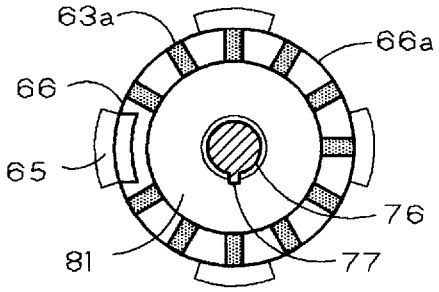
FIG. 9—a cross sectional view on line 9—9, FIG. 7 through the adjusting end 66 and the inner rod 76.

About FIGS. 7,8,9, the main tube 63 with the main rod 78 located on the interior, are joined approximately at mid-span by a flange holder 83 that is on the inner surface of the tube 63 and a flange 82*b* that is located on the rod 78.

This joining prevents the tube 63 and the rod 78 from separating from each other and prevents any lateral movement between the two parts but allows the main tube 63 to rotate about the axis of the main rod 78.

At the end of the inner rod 76 is a flange 82 (both parts being integral) that operates within the flange holder 81 at the end of the adjusting end 66. This joins the inner rod 76 to the adjusting end 66 and still allows the adjusting end 66 to rotate and to move laterally along the main tube 63.

Therefore when the adjusting end 66 moves laterally along the main tube 63 the inner rod 76 will also move laterally along with it.

Also located on the adjusting end 66 is a catch 65 that is used to aid the special material 24 to keep its placement as it is unwound from the roller and enters the guide 34.

Figure 10:
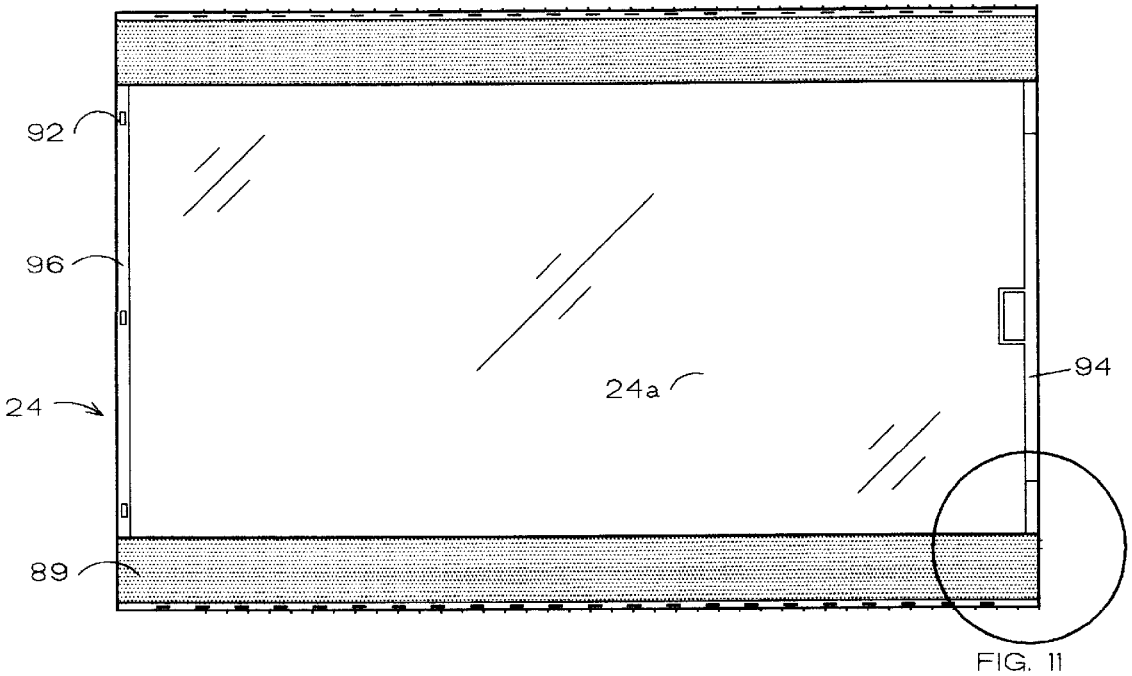
FIG. 10—an elevation view of the sheet material 24.
Figure 11:
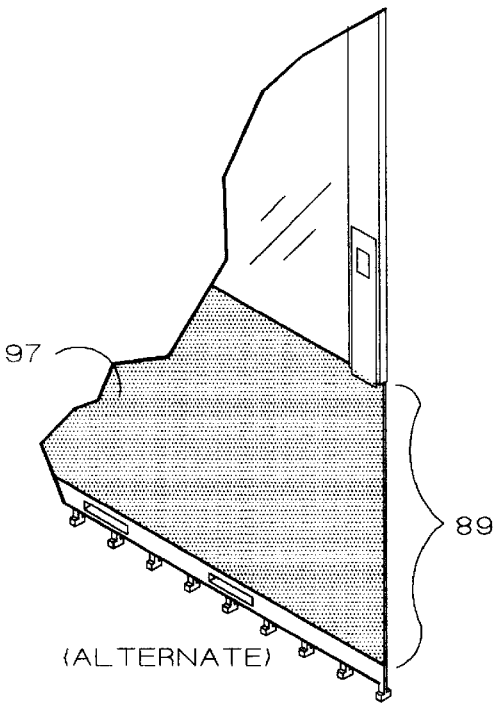
FIG. 11—enlarged partial view of the stretchable ends 89, including an alternate drawing.
Figure 11:
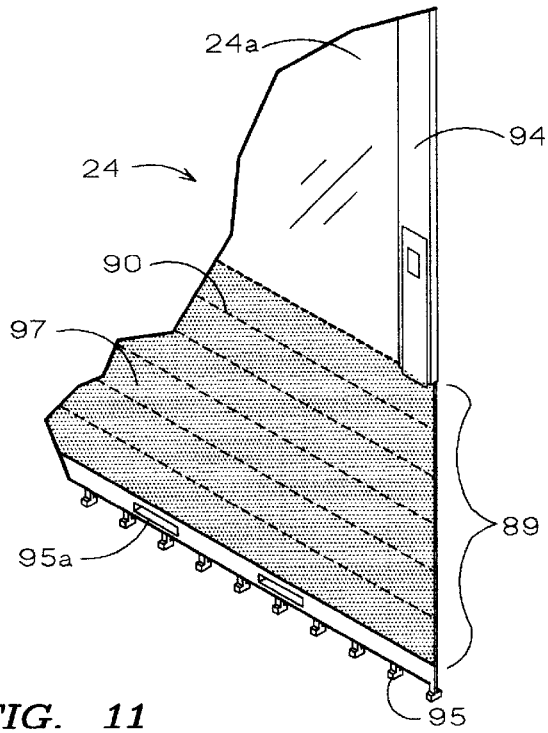

About FIGS. 10,11, the special rolled-sheet-material 24 is a sheet comprising of a flexible non-stretchable material 24*a* that has stretchable-ends 89 that are attached to the extremities of the non-stretchable material 24*a*. The stretchable-ends 89 adjust to fit the adjusting ends 66 when they are in an extended position.

The stretchable-ends 89 are a composite of several smaller portions of polyurethane referred to as an expander 97 that are heat sealed or chemically sealed at the seams 90 along the sheet.

In FIG. 11, a drawing labeled "alternate," shows the stretchable-ends 89 as being a single expander 97 rather than a composite of expanders 97 as shown in the main FIG. 11. This single expander 97 shown in the "alternate," could have an equal or greater elongation to the composite of expanders 97 shown in the main FIG. 11.

Adjacent to the stretchable-ends 89 are a plurality of slots 95*a* at consistent intervals along the length of the non-stretchable sheet 24*a* that allows the stretchable-ends 89 to remain in tension by means of the catch 65 located on the adjusting end 66 when the special rolled sheet material 24*a* is rolled up on the tube assembly 62.

The portion of the stretchable-ends 89 that will secure the special rolled sheet material 24 to the track 26 are the hooks 95 used to keep the stretchable-ends 89 placed properly in the track 26. The hooks 95 are equally spaced per revolution in such a way, that for every revolution that the hooks 95 make, the next generation moves just beyond the width of the previous generation of hooks 95 so as not to interfere with the last generation of hooks.

The ability to adjust the stretchable ends 89 will aid to meet the demand that the adjusting end 66 will require as it extends from the main tube 63.

A bar 96 fits into the channel 64 located on the main tube 63. This bar 96 is secured at the slot 80. At the opposite end of the rolled sheet material another bar 94 that has a handle for pulling the rolled sheet material 24 along the track assembly 26.

I claim:

1. A shade insulator screen system for adjustably fitting various sized openings comprising an elongated adjustable housing having a longitudinal axis, said adjustable housing comprising opposite housing ends adjustably spaced apart along said axis, the housing ends being adjustably interconnected by a bar member, a flexible cover attached to said housing ends and extending therebetween along said axis, said flexible cover being adjustable, said housing ends and said flexible cover each having a slit therein extending parallel to said longitudinal axis, said slit being aligned to define a continuous slit extending substantially the length of said housing, a cap member located approximate each end of said housing for supporting a roller mechanism, a roller mechanism comprising a tube having a main tube section and opposing end sections slideably engaged therewith, said roller mechanism further comprising a rod having a main rod section and opposing end sections slideably engaged therewith, said main rod being fixed and rotatively supporting said tube, said roller mechanism being supported by said cap members.

2. A shade insulator screen system as claimed in claim 1 further comprising a flexible sheet having one end which is attached to said tube and an opposite free end, said sheet adapted to be rolled on and unrolled from said tube, said sheet having a main portion comprising a flexible non-stretchable material and side portions comprising stretchable material, said side portions extending from said one end to said free end of said sheet and on opposite sides of said main portion whereby said housing and roller mechanism being longitudinally adjustable at the stretchable side portions compensating adjustability thereby permitting locations of this system in various sized openings.

3. A shade insulator screen system as claimed in claim 1 further including outer caps comprised of a flat body of material having a wing attached to said body, said wing further having a guide element for engaging said housing ends.

4. A shade insulator screen system as claimed in claim 1 wherein said housing ends have attachment means for said respective cap members.

5. A shade insulator screen system as claimed in claim 1 wherein said cap members further include guide means for gripping and containing said flexible sheet and having a mechanism for securing said cap members to said housing ends.

6. A shade insulator screen system as claimed in claim 5 wherein said cap members have a geometrically shaped socket having interconnecting means to respective said end rod.

7. A shade insulator screen system as claimed in claim 3 wherein said outer caps support said housing in a structure as said caps are secured thereto, said caps further allowing the removal of said housing therefrom said caps.

8. A shade insulator screen system as claimed in claim 1 wherein the diameter of said main tube section is equal to the diameter of said end tube sections, said main tube section and said end tube sections having a common channel along the surfaces thereof.

9. A shade insulator screen system as claimed in claim 1 whereby said main rod section has a length approximate to the length of said main tube section and said end rod sections each having a length approximate to said end tube sections.

10. A shade insulator screen system as claimed in claim 1 whereby said rod mechanism having support means for a retraction mechanism.

11. A shade insulator screen system as claimed in claim 1 whereby said main tube section is rotatable about the axis of said roller mechanism.

12. A shade insulator screen system as claimed in claim 1 whereby said end tube sections are rotative about the axis of said roller mechanism and having axial means of movement respective to said main tube section.

13. A shade insulator screen system as claimed in claim 1 wherein said end rod sections each have a key that engages a keyway on said main rod section.

14. A shade insulator screen system as claimed in claim 1 wherein said end tube sections are rotatively interconnected to said end rod sections.

15. A shade insulator screen system as claimed in claim 1 wherein said main tube section is interconnected to said main rod section.

16. A shade insulator screen system as claimed in claim 1 further including a bar of detachable means from said roller tube mechanism, said bar having attachment means respectively to said rolled sheet material.

17. A shade insulator screen system as claimed in claim 2 wherein a plurality of hooks are located along said stretchable side portions, said hooks are arranged in such a way that for every generation of hooks per revolution as said flexible sheet is rolled on said tube the next generation is radially spaced from the hooks of the previous generation of hooks.

18. A shade insulator screen system comprising an adjustable housing, said housing having separate housing ends, said housing ends being movably connected by a connecting means and a flexible cover positioned between said housing ends, said housing further including an adjustable roller tube, said tube having a main tube and end tubes that have mating projections that allow the tubes to be joined axially thereby allowing movement of the main and end tubes axially with respect to each other, said roller tube further including a rod having a main rod section and opposing end rod sections wherein said main and end tube sections are rotatable, said end tubes further including catches extending beyond the diameter of said end tubes.

19. A shade insulator screen system as claimed in claim 1 wherein said roller mechanism is removable from said housing, said roller mechanism having support means for various rolled sheet materials.

* * * * *